US009851147B2

(12) United States Patent
Christensen et al.

(10) Patent No.: US 9,851,147 B2
(45) Date of Patent: Dec. 26, 2017

(54) SPIN FLASH DRYER FOR PRODUCING A POWDER BY SPIN FLASH DRYING

(71) Applicant: SPX FLOW TECHNOLOGY DANMARK A/S, Søborg (DK)

(72) Inventors: Michael Christensen, Smørum (DK); Per Nielsen, Bagsværd (DK)

(73) Assignee: SPX FLOW TECHNOLOGY (DANMARK A/S), Søborg (DK)

( * ) Notice: Subject to any disclaimer, the term of this patent is extended or adjusted under 35 U.S.C. 154(b) by 0 days.

(21) Appl. No.: 15/122,537

(22) PCT Filed: Mar. 13, 2015

(86) PCT No.: PCT/EP2015/055283
§ 371 (c)(1),
(2) Date: Aug. 30, 2016

(87) PCT Pub. No.: WO2015/136070
PCT Pub. Date: Sep. 17, 2015

(65) Prior Publication Data

US 2017/0074586 A1 Mar. 16, 2017

(30) Foreign Application Priority Data

Mar. 13, 2014 (DK) ..... 2014 00139

(51) Int. Cl.
*F26B 25/04* (2006.01)
*F26B 3/092* (2006.01)
*F26B 17/10* (2006.01)

(52) U.S. Cl.
CPC ..... *F26B 25/04* (2013.01); *F26B 3/0923* (2013.01); *F26B 17/102* (2013.01); (Continued)

(58) Field of Classification Search
CPC .... F26B 2/0923; F26B 17/102; F26B 17/103; F26B 17/104; F26B 25/04; F26B 2200/02; B01D 1/16; B01D 1/18
(Continued)

(56) References Cited

U.S. PATENT DOCUMENTS 3,869,808 A * 3/1975 Sawyer ..... F16B 21/00 165/89
3,913,238 A * 10/1975 Updegrove ..... B01F 7/302 34/181
(Continued)

FOREIGN PATENT DOCUMENTS

CH 327 400 1/1958
CN 202562247 11/2012
(Continued)

OTHER PUBLICATIONS

International Search Report issued in International Patent Application No. PCT/EP2015/055283 dated May 19, 2015.

*Primary Examiner* — Stephen M Gravini
(74) *Attorney, Agent, or Firm* — Baker and Hostetler LLP

(57) ABSTRACT

Herein is disclosed a spin flash dryer further comprising a waste outlet arranged in a chamber bottom of the spin flash dryer for removal of a residual organic waste material from a spin flash dryer during spin flash operation and a method of operating a such spin flash dryer to remove residual organic waste material from said spin flash dryer during operation.

9 Claims, 1 Drawing Sheet

(52) U.S. Cl.
CPC ..... *F26B 17/103* (2013.01); *F26B 17/104* (2013.01); *F26B 17/108* (2013.01); *F26B 2200/02* (2013.01)

(58) Field of Classification Search
USPC ..... 34/427, 90; 159/48.1
See application file for complete search history.

(56) References Cited

U.S. PATENT DOCUMENTS 4,030,205 A * 6/1977 Robertson ..... B29B 13/065 34/380
4,203,228 A * 5/1980 Aradi ..... F26B 3/0923 34/368
6,085,440 A * 7/2000 Getler ..... F26B 3/0923 34/135
7,080,463 B1 * 7/2006 Johnson ..... A47J 43/24 34/312
7,984,566 B2 * 7/2011 Staples ..... F26B 17/103 159/4.02
8,590,174 B2 * 11/2013 Rose ..... B08B 3/042 134/104.2
9,492,851 B2 * 11/2016 Powell ..... C10G 3/55
2003/0037922 A1 * 2/2003 Gibson ..... B09B 3/0091 166/206
2011/0030237 A1 * 2/2011 Schmidt ..... F26B 3/02 34/498
2017/0074586 A1 * 3/2017 Christensen ..... F26B 3/0923

FOREIGN PATENT DOCUMENTS

DK WO 2015136070 A1 * 9/2015 ..... F26B 3/0923
EP 0 141 403 5/1935
WO 97/19307 5/1997
WO 03/018954 3/2003

* cited by examiner

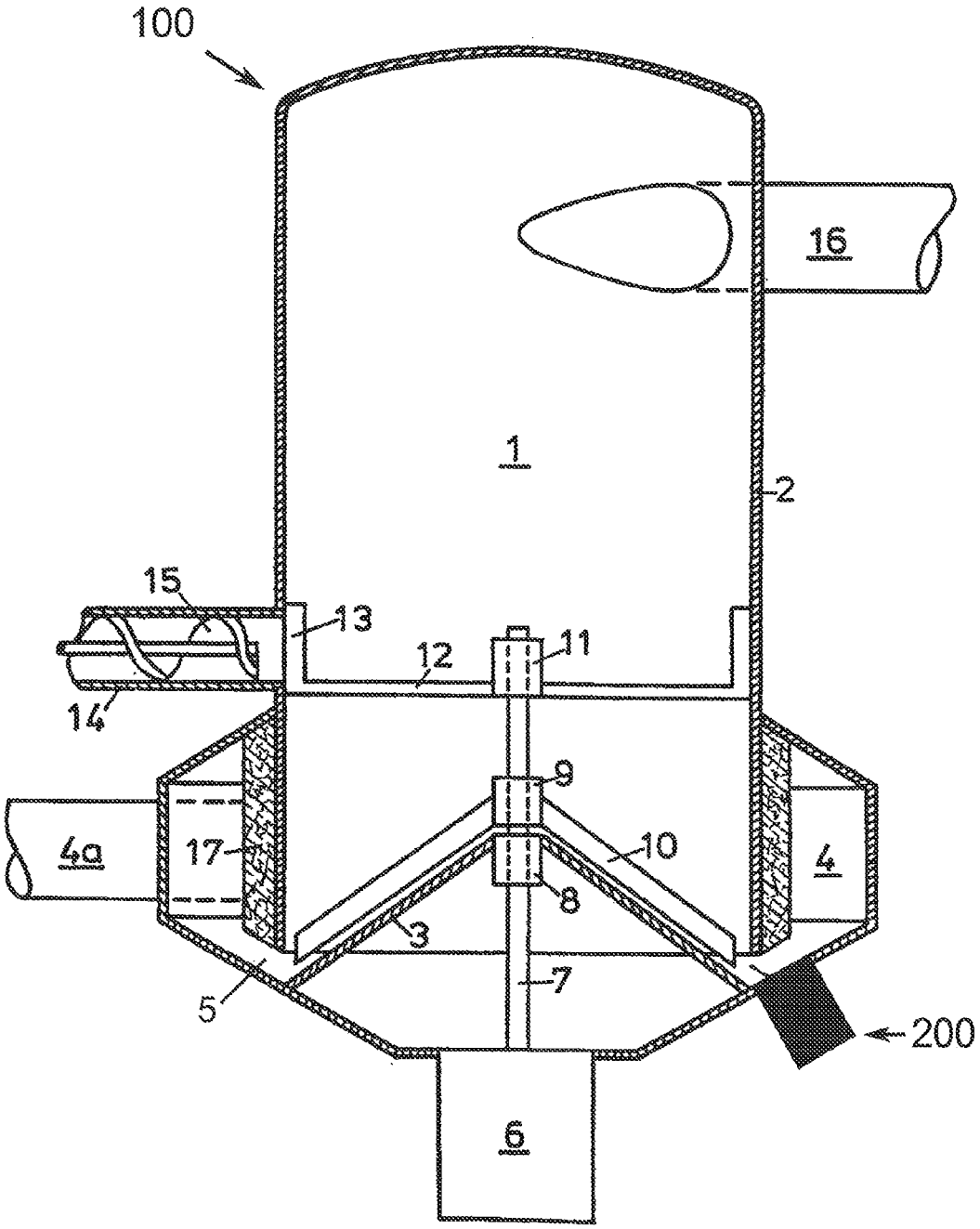
100
16
1
2
15
13
12
11
14
9
4a
17
10
4
8
3
7
5
200
6

SPIN FLASH DRYER FOR PRODUCING A POWDER BY SPIN FLASH DRYING

REFERENCE TO RELATED APPLICATIONS

This application is the U.S. national stage of International Application No. PCT/EP2015/055283, filed Mar. 13, 2015, which claims priority to Danish Application No. PA201400139, filed Mar. 13, 2014, the disclosures of which are incorporated herein by reference in their entirety.

FIELD

The present disclosure relates to a spin flash dryer for producing a powder by spin flash drying, in particular for use in the field of food waste disposal.

BACKGROUND

The present disclosure relates to a spin flash dryer for producing a powder by spin flash drying in particular for use in the field of food waste disposal.

The disclosure specifically relates to spin flash dryer for drying of a material, in particular from the food processing industry, in the form of a paste or a filter cake, with a vertical, cylindrical, dryer chamber having a rotating coaxially placed stirrer, with a variable speed drive screw feeder and with apertures for supply of hot drying gas and for removal of the spent drying gas and removal of the dried material.

Feed material preferably dried according to the invention are organic materials, preferably organic waste materials such as e.g. food waste products, fruit and beet pulps, distillers' residues, waste products comprising animal blood such as e.g. slaughterhouse animal waste, proteins, carbohydrates such as e.g. sugars and starches, fatty waste, and non-caking permeates. Preferred organic waste materials are waste products comprising blood. The feed material can e.g. be a liquid suspension comprising a solids fraction, a paste, or a filter cake material, wherein a fraction of the liquid suspension comprising a solids fraction, the paste, or the filter cake material has a particulate size which is too large to undergo spin flash drying, i.e. which density is larger than the lifting power of the fluidization medium of the spin flash dryer, or alternatively wherein the solids fraction is formed during operation of the spin flash dryer by aggregation or agglomeration.

It is well known, e.g. from EP 0 141 403 to dry materials in the form of a paste or filter cake to obtain a powder. In this apparatus the produced powder particles sizes are all under a given cut size and the residual drying gas is furthermore emitted to the environment. Likewise it is well-known e.g. from WO 97/19307 to spin flash dry powder with a desired mean particle size and a narrow particle size distribution.

As spin flash drying has gained popularity the materials which have been dried in these dryers have increased in complexity and today it is not uncommon to attempt to dry materials, wherein the material to be dried can be formed into a paste or a filter cake, but wherein this material nevertheless comprises a fraction of the paste or filter cake material, that has a particulate size which is too large to undergo spin flash drying, or wherein a fraction of the material to be dried undergoes insufficient particulation during drying thereby forming agglomerates which cannot be lifted by the drying air and out of the spin flash dryer.

Such a situation is particularly often observed in the food processing industry, where the residual organic material supplied to the spin flash dryer often aggregates and agglomerates during spin flash drying, thereby forming agglomerates which accumulate at the bottom of the spin flash dryer. This is highly unwanted and has several undesired consequences, such as e.g. increasing residence time of the material in the spin flash dryer, reducing the spin flash dryer's capacity as well as decreasing the intervals between maintenance stops.

This situation in particular is often observed in the meat processing industry. Waste materials from meat processing often contain useful organic components which cannot be separated from the carcass of the animal body in the normal process of cutting and parting the animal. However, such waste materials from meat processing can be utilized in further industrialized process steps. For example meat processing by-products comprising an animal blood fraction are useful by-products of the meat processing industry which advantageously can be spin flash dried to obtain powders enriched in blood.

However, in pastes or filter cakes comprising a meat processing by-product comprising an animal blood fraction it is often the situation that the by-product also comprises a fraction of material, e.g. crushed bones from the animal carcass, which cannot undergo spin-flash drying and therefore accumulates at the bottom of the spin flash dryer, or, which is more common, particles of ligaments and sinews together with the ever present blood, coagulate and become gluey under the processing conditions of the spin flash dryer, and start forming very large, kg-scale, conglomerates of spin flash waste which cannot undergo spin flash drying. However, by authorities, and for economic reasons, the ability to correctly treat by-products of the meat processing industry comprising blood and crushed bones material is considered essential for health and environmental reasons.

In general, accumulation of material, in particular of waste materials buildup, at the bottom of a spin flash dryer is cumbersome to handle as removal of this material generally requires the processing line to be shut down during maintenance, which may entail disassembling the spin flash dryer and long waiting times in order for the dryer to cool to temperatures which permit operator access to the drying chamber. Also, when food products is concerned, operator access is highly unwanted as it will disturb (or contaminate) the biological integrity of the spin flash drying system.

There exists, therefore, the need for a spin flash dryer which can handle such agglomerating materials without requiring an increased number of maintenance stops.

WO 03/018954 discloses a cuttings processing system including a steam atmosphere spin flash drying chamber able to process oil-enriched rock cuttings in an inert atmosphere for direct installation on an off-shore oil platform. The spin flash unit included in the cuttings processing system of WO 03/018954 includes a drain and overs discharge for access to the spin flash unit during operation down time. Spin flash drying of oil-enriched material is a particular dangerous process and the cuttings processing system is designed to stay closed during operation to prevent or reduce the risk of fire on the oil platform. Due to the manner in which oil is drilled, rock cuttings have uniform size distributions with only a minor fraction having a size which is too large to undergo spin flash drying. Further, rock does not undergo agglomeration. Rather, the rock fraction will accumulate, but not aggregate, at the bottom of the spin flash dryer and for safety reasons must be removed during intermissions for maintenance in the production line.

In the context of the present disclosure, waste material is to be understood as any matter contained in a feed material for a spin flash dryer, typically a paste or filter cake material, fed to a spin flash dryer, which waste material cannot undergo particulation and/or flocculation to become a dried spin flash product in a spin flash dryer and be lifted by the drying air flow against the gravitational force to exit the spin flash drying chamber through an aperture for removal of a dried spin flash product from the drying chamber of the spin flash dryer.

Such waste materials are routinely observed to form in many spin flash drying processes as residuals still contained in the drying chamber (1) after an interval of drying time otherwise considered sufficient for particulation and flocculation of the feed material.

In CN 202562247 (U) there is disclosed a drying unit, in particular a spin flash dryer, comprising a spin flash drying room, a dispersing device, a driving device, a revolving shaft, an air inlet and a feed inlet. The revolving shaft is connected with the driving device, the dispersing device is connected with the revolving shaft, and the dispersing device and the revolving shaft are arranged inside the spin flash drying room. The dispersing device comprises more than three dispersing vanes, and one end of the dispersing vanes is connected with the revolving shaft to form an annular dispersing surface. The spin flash dryer of the described invention is directed to effective avoidance of materials buildup on the bottom of a dryer through the dispersing device.

The present inventors have now realized the need for further improvements in spin flash dryers to overcome unwanted effects on the drying process and spin flash chamber due to residual organic waste material buildup on the bottom of such a spin flash dryer, in particular in the field of food processing, and most in particular in the field of waste products from the food processing industry comprising blood.

SUMMARY OF THE INVENTION

The invention is disclosed in the present description and drawings and in the claims.

As according to a first aspect and embodiment there is disclosed a spin flash dryer comprising a drying chamber enclosed by at least a chamber wall and a chamber bottom; a rotating stirrer, said rotating stirrer arranged in said drying chamber near said chamber bottom, said rotating stirrer being provided with a plurality of stirring blades; members for the supply of a material to be dried, said members arranged in said chamber wall to permit the passage of a material to be dried from the exterior of said drying chamber to the interior of said drying chamber; apertures for supply and removal of a medium for fluidization and drying and for removal of a dried product, said aperture for supply of the fluidization and drying medium being positioned in said drying chamber wall between said chamber bottom and said aperture for removal of a dried product in said drying chamber; said spin flash dryer further comprising a waste outlet arranged in said chamber bottom of said spin flash dryer; and wherein said waste outlet is arranged for continuous removal of residual organic waste material, which residual organic waste material cannot be spin flash dried due to a density of said residual organic waste material being higher than a lifting power of said medium for fluidization and drying of said spin flash dryer; wherein said waste outlet is a valve which can form a sluice; and wherein removal is caused by said rotating stirrer moving said residual organic waste material into said waste outlet during spin flash dryer operation upon which said residual organic waste material is removed via said waste outlet in a sluicing operation.

As according to an embodiment there is disclosed a spin flash dryer wherein said waste outlet is arranged at or near the bottommost point, line, or plane of said chamber bottom.

As according to an embodiment there is disclosed a spin flash dryer, wherein said waste outlet is adapted for connecting to an arrangement for transporting waste material from the interior of said drying chamber to the exterior of said drying chamber.

As according to an embodiment there is disclosed a spin flash dryer, wherein said arrangement for transporting waste material from the interior of said drying chamber to the exterior of said drying chamber comprises a re-attachable lid for covering said waste outlet during operation of said spin flash dryer, which lid can be detached from said waste outlet during an intermission of operation of said spin flash dryer to remove any waste material accreted at or near said waste outlet on said chamber bottom manually.

As according to an embodiment there is disclosed a spin flash dryer, wherein said sluice comprises a rotating arrangement of openings and closures adapted to maintain an essentially fluid tight seal between the interior of said drying chamber and the exterior of said drying chamber during operation of said sluice and said spin flash dryer. Preferably, said rotating arrangement of openings and closures is a rotary valve or a sliding valve.

As according to an embodiment there is disclosed a spin flash dryer, wherein said arrangement for transporting waste material is spaced below said waste outlet by an intersection, said intersection e.g. being a length of a conduit or pipe.

As according to an embodiment there is disclosed a spin flash dryer, wherein said chamber bottom is a conical chamber bottom which extends conically tapering upwards inside said drying chamber.

As according to an embodiment there is disclosed a spin flash dryer, said spin flash dryer further comprising an annular distributor for distributing said fluidization and drying medium, said annular distributor surrounding a lower region of said chamber wall, whereby said fluidization and drying medium is led into the drying chamber in an evenly manner.

As according to an embodiment there is disclosed a spin flash dryer wherein the organic materials feed materials are selected from organic waste materials comprising food waste products, fruit and beet, pulp, distillers' residues, waste products comprising animal blood, slaughterhouse animal waste, proteins, carbohydrates, sugars, starches, fatty waste, and/or non-caking permeates.

As according to an embodiment there is disclosed a method of removing residual organic waste material from the interior of a spin flash dryer during spin flash dryer operation, wherein removal is caused by a rotating stirrer moving said residual organic waste material into a waste outlet during spin flash dryer operation upon which said residual organic waste material is removed via said waste outlet in a sluicing operation.

BRIEF DESCRIPTION OF THE DRAWINGS

FIG. 1: Exemplary spin flash dryer with waste outlet.

DETAILED DESCRIPTION

Spin flash dryers for fluid bed drying, particularly for simultaneous drying and disintegration of a material in the form of a paste or a filter cake are commonly known.

An exemplary spin flash dryer according to the invention is shown in FIG. 1, wherein a prior art spin flash dryer (100) has been mounted with a waste outlet (200) according to the invention.

In FIG. 1 a spin flash dryer (100) of the prior art is shown, wherein the spin flash dryer further comprises a waste outlet (200) of the invention. Spin flash dryers (100) of the prior art are in general constructed with a drying chamber (1) enclosed by a chamber wall (2), and having a chamber bottom (3) in fixed connection therewith. A rotating stirrer (9, 10) will usually be arranged coaxially in the drying chamber (1) near its chamber bottom (3) on a shaft (7) which transfers a rotation from a rotor (6) to the stirrer (9). Usually, the stirrer (9) is provided with a plurality of stirring blades (10). The blades (10) of the stirrer (9) are normally arranged in parallel to the chamber bottom (3), but depending on function, modifications to stirrer (9) and stirrer blades (10) are known.

Further the drying chamber (1) will comprise members (14, 15) for the supply of a material to be dried, apertures (5, 16) for supply (5) and removal (16) of a medium for fluidization and drying and for removal (16) of a dried product.

In many spin flash dryers of the prior art, the chamber bottom (3) is a conical chamber bottom (3) which extends conically tapering upwards inside the chamber (1).

Usually, the aperture for supply of the fluidization and drying medium (5) is positioned in the drying chamber wall (2) between the chamber bottom (3) and the aperture (16) for removal of a dried product in the drying chamber (1). Also customarily, an annular distributor (4) for distributing the fluidization and drying medium is surrounding the lower region of the chamber wall (2) whereby the fluidization and drying medium is led into the drying chamber (1) in an evenly manner.

Usually in spin flash dryers of the prior art the blades (10) of the stirrer (9) are positioned at a relatively small distance from the chamber bottom (3). It is well known to add further stirrer elements (11, 12, 13) coaxially on the rotating shaft (7).

Likewise it is commonly known in the prior art for the drying chamber (1) and the annular distributor (4) to have a stretch of common wall, which is heat insulated (17) on the side facing the distributor (4).

Likewise commonly known in the prior art is for the drying chamber (1) to include at least one particle size classifier positioned inside the drying chamber (1) above the stirrer (9) but below the aperture (16) for removal of a dried product. Thereby the particle size of the dried product may advantageously be controlled. In such embodiments of the prior art comprising particle size classifiers, a plurality of apertures (16) may be comprised in the spin flash dryer of the prior art (100).

To a spin flash dryer of the prior art (100), the present inventors suggest the addition of a waste outlet (200) positioned in the chamber bottom (3) of the spin flash dryer (100). A waste outlet (200) of the invention will be dimensioned according to the particular needs of the individual spin flash dryer into which it will be installed, but will often have a dimension between 30 mm to 1000 mm, usually between 100 mm to 300 mm.

It is advantageous if a waste outlet (200) of the invention is positioned at or near the bottommost point, line, or plane of the chamber bottom (3). Thereby it is secured that gravitation and forces exerted by the stirrer (9) and blades (10) on the paste or filter cake mass contained in the drying chamber will drive any waste material towards and into the waste outlet (200), from where it may be removed at a time of an operator's choice. Preferentially waste material can be removed continuously during operation of the spin flash dryer.

Advantageously, the waste outlet (200) is adapted for connecting to an arrangement for transporting waste material from the interior of the drying chamber (1) to the exterior of the drying chamber (1). Such an adaptation could e.g. be by a flange section on said waste outlet (200) and secured using nuts and bolts.

In one embodiment of the waste outlet (200), said arrangement for transporting waste material comprises a re-attachable lid for covering the waste outlet (200) during operation of the spin flash dryer (100), which lid can be detached from the waste outlet (200) during an intermission of operation of the spin flash dryer (100) to remove any waste material accreted at or near the waste outlet (200) on the chamber bottom (3) of the spin flash dryer (100) manually.

In another embodiment of the waste outlet (200), said arrangement for transporting waste material comprises a sluice adapted to permit the passage of waste material from the interior of the drying chamber (1) during operation of the spin flash dryer (100) in a sluicing operation. The sluice can e.g. be a check valve or any other type of non-return valves such as e.g. butterfly valves, double butterfly valves, or rotating valves. In a preferred embodiment the sluice comprises a revolving arrangement of openings and closures adapted to maintain an essentially fluid tight seal between the drying chamber (1) and the exterior of said drying chamber during operation of sluice and spin flash dryer. Preferably, said revolving arrangement of openings and closures is a rotating valve or sliding valve.

In a further embodiment of the waste outlet (200), said arrangement for transporting waste material is spaced below said waste outlet by an intersection, said intersection e.g. being a length of a conduit or pipe. Thereby a calm zone is created below the chamber bottom which will facilitate efficient removal of waste material during operation without interfering with the drying process.

Closing Comments

The term "comprising" as used in the claims does not exclude other elements or steps. The term "a" or "an" as used in the claims does not exclude a plurality.

Although the present invention has been described in detail for purpose of illustration, it is understood that such detail is solely for that purpose, and variations can be made therein by those skilled in the art without departing from the scope of the invention.

The invention claimed is:

1. A spin flash dryer comprising:

a drying chamber enclosed by at least a chamber wall and a chamber bottom; thereby defining an exterior and an interior of said drying chamber, a rotating stirrer, said rotating stirrer arranged in said drying chamber near said chamber bottom, said rotating stirrer being provided with a plurality of stirring blades;

members for supply of a material to be dried, said members arranged in said chamber wall to permit passage of a material to be dried from the exterior of said drying chamber to the ulterior of said drying chamber;

apertures for supply and removal of a medium for fluidization and drying and for removal of a dried product, said aperture for supply of said fluidization and drying medium, being positioned in said drying chamber wall between said chamber bottom and said aperture for removal of a dried product in said drying chamber; said spin flash dryer further comprising:

a waste outlet arranged in said chamber bottom of said spin flash dryer; and wherein said waste outlet is arranged for continuous removal of residual organic waste material, which residual organic waste material cannot be spin flash dried due to a density of said residual organic waste material being higher than a lifting power of said medium for fluidization and drying of said spin flash dryer; wherein said waste outlet is a valve which forms a sluice; and wherein removal is caused by said rotating stirrer moving said residual organic waste material into said waste outlet during spin flash dryer operation upon which said residual organic waste material is removed via said waste outlet in a sluicing operation, wherein said sluice comprises a rotating arrangement of openings and closures adapted to maintain an essentially fluid tight seal between the interior of said drying chamber and the exterior of said drying chamber during operation of said sluice and said spin flash dryer.

2. A spin flash dryer according, to claim 1, wherein said waste outlet is arranged at or near the bottommost point, line, or plane of said chamber bottom.

3. A spin flash dryer according to claim 1, wherein said waste outlet is adapted for connecting to an arrangement for transporting waste material from the interior of said drying chamber to the exterior of said drying chamber.

4. A spin flash dryer according to claim 3, wherein said arrangement for transporting waste material from the interior of said drying chamber to the exterior of said drying chamber comprises a re-attachable lid for covering said waste outlet during operation of said spin flash dryer, which lid can be detached from said waste outlet during an intermission of operation of said spin flash dryer to remove any waste material accreted at or near said waste outlet on said chamber bottom manually.

5. A spin flash dryer according to claim 4, wherein said arrangement for transporting waste material is spaced below said waste outlet by an intersection, said intersection being a length of a conduit or pipe.

6. A spin flash dryer according to claim 1, wherein said chamber bottom is a conical chamber bottom which extends conically tapering upwards inside said drying chamber.

7. A spin flash dryer according to claim 1, further comprising an annular distributor for distributing said fluidization and drying medium, said annular distributor surrounding a lower region of said chamber wall, whereby said fluidization and drying medium is led into the drying chamber in an evenly manner.

8. A spin flash dryer according to claim 1, wherein the organic materials feed materials are selected from organic waste materials comprising food waste products, fruit and beet pulps, distillers' residues, waste products comprising animal blood, slaughterhouse animal waste, proteins, carbohydrates, sugars, starches, fatty waste, and/or non-caking permeates.

9. A method of removing residual organic waste material from an interior of a spin flash dryer during spin flash dryer operation, wherein removal is caused by a rotating stirrer moving said residual organic waste material into a waste outlet during spin flash dryer operation upon which, said residual organic waste material is removed via said waste outlet in a sluicing operation.

* * * * *